US006763947B1

(12) United States Patent
Brooks

(10) Patent No.: US 6,763,947 B1
(45) Date of Patent: Jul. 20, 2004

(54) FLOTATION SEPARATION APPARATUS AND INFUSER THEREFOR

(76) Inventor: George C. Brooks, P.O. Box 800, Lakeland, FL (US) 33802-0800

( * ) Notice: Subject to any disclaimer, the term of this patent is extended or adjusted under 35 U.S.C. 154(b) by 0 days.

(21) Appl. No.: 10/693,408

(22) Filed: Oct. 27, 2003

(51) Int. Cl.[7] ..... B03D 1/14; B03D 1/24; B01F 3/04

(52) U.S. Cl. ..... 209/170; 209/168; 261/79.2; 261/77; 261/123; 366/337; 366/338; 366/341

(58) Field of Search ..... 209/168, 170; 261/79.2, 77, 123; 366/337, 338, 341

(56) References Cited

U.S. PATENT DOCUMENTS 3,400,818 A * 9/1968 Tarjan ..... 209/170
3,446,353 A * 5/1969 Davis ..... 209/164
4,212,730 A * 7/1980 Brooks et al. ..... 209/168
4,613,431 A * 9/1986 Miller ..... 209/169

* cited by examiner

*Primary Examiner*—Thomas M. Lithgow
(74) *Attorney, Agent, or Firm*—George A. Bode; Lisa D. Velez; Bode & Associates

(57) ABSTRACT

An improved flotation separation apparatus for separating and classifying diverse, liquid-suspended solids having a plurality of high volume air bubble infusers. Each infuser includes a circular cavity defined by an interior circumferential wall. A plurality of stationary impinging plates projecting from the interior circumferential wall into the circular cavity and equally spaced circumferentially in series therealong. An injecting stream of water and air impinges upon the impinging plates in series to repeatedly create, divide and subdivide air bubbles as the injection stream transverses the series of impinging plates.

9 Claims, 4 Drawing Sheets

FLOTATION SEPARATION APPARATUS AND INFUSER THEREFOR

BACKGROUND OF THE INVENTION

1. Field of the Invention

The present invention relates to floatation separation apparatuses and, more particularly, to an improved flotation separation apparatus which includes a plurality of unique high volume air bubble infusers to create a high multiplicity of strong finely divided bubbles.

2. General Background

Today's coal and mineral producers like all industry is faces with rising costs accompanied by customer resistance to increases in price and competition from imported raw material. In order to maintain the competitive edge an operator must seek means in acquiring processing units which afford lower capital investment cost, lower power and maintenance requirements along with higher recovery of valued products.

An example of an existing separating and classifying flotation system is described in U.S. Pat. No. 4,212,730, to Brooks et al., entitled "APPARATUS FOR SEPARATING AND CLASSIFYING DIVERSE, LIQUID-SUSPENDED SOLIDS", incorporated herein by reference as if set forth in full below. The Brooks patent discloses a floatation separation apparatus which includes air bubble infusers each of which are fed by air and water pipes.

SUMMARY OF THE PRESENT INVENTION

The preferred embodiment of the flotation separation apparatus of the present invention solves the aforementioned problems in a straight forward and simple manner. What is provided is an improved flotation separation apparatus which includes a plurality of unique high volume air bubble infusers to create a high multiplicity of strong, finely divided bubbles. Thereby, such multiplicity of strong, finely divided bubbles provides that means required for the transport of recoverable minerals in the flotation process.

Broadly, the unique high volume air bubble infuser of the present invention includes a circular cavity and a plurality of stationary impinging plates projecting from the interior circumferential wall into the circular cavity and equally spaced circumferentially in series therealong. Thereby, an injecting stream impinges upon the impinging plates in series to repeatedly create, divide and subdivide air bubbles as the injection stream transverses the series of impinging plates.

In general, the improved flotation separation apparatus for separating and classifying diverse, liquid-suspended solids comprises a first chamber and a second chamber stacked below said first chamber in fluid communication with said first chamber, the improvement comprising a first set of a plurality of high volume air bubble infusers spaced in said first chamber; and, a second set of a plurality of unique high volume air bubble infusers spaced in said second chamber.

Each unique high volume air bubble infuser comprises a structure having formed centrally in a top surface thereof a circular cavity defining an interior circumferential wall and centrally in a bottom surface parallel to said top surface a bubble-water discharge outlet coaxial with an axis of said circular cavity; a lid member secured to said top surface of said structure; a water inlet port formed in said circular cavity for injecting a water steam into said circular cavity offset from said axis and perpendicular to said axis; an air inlet port formed in said circular cavity for injecting an air stream into said water stream at an acute angle; and, a plurality of stationary impinging plates projecting from said interior circumferential wall into said circular cavity and spaced circumferentially in series therealong.

In view of the above, it is an object of the present invention to provide a unique high volume air bubble infuser which maximizes the creation of the transport means (strong air bubbles) required for the transport of recoverable minerals in the flotation process and thus increases the recovery efficiency at the lowest possible power consumption per ton.

Another object of the invention is to provide an injection stream which impinges in series upon the stationary impinging plates to create, divide and subdivide repeatedly in series air bubbles.

A further object of the present invention is to provide the infuser with a circular cavity which is a relatively narrow circular cavity for injecting therein at a relatively high rate an injection stream to create a sufficient impact force through the series of stationary impinging plates to maximize the rate of the creation of said air bubbles and the discharge thereof through the bubble-water discharge outlet.

It is a still further object of the present invention to provide ten (10) impinging plates equally spaced incrementally over substantially 270 degrees of said circular cavity.

In view of the above objects, it is a feature of the present invention to provide a unique high volume air bubble infuser which is relatively simple structurally and thus simple to manufacture.

The above objects and other features of the present invention will become apparent from the drawing, the description given herein, and the appended claims.

BRIEF DESCRIPTION OF THE DRAWING

For a further understanding of the nature and objects of the present invention, reference should be had to the following description taken in conjunction with the accompanying drawing in which like parts are given like reference numerals and, wherein.

DETAILED DESCRIPTION OF THE PREFERRED EMBODIMENT

Figure 1:
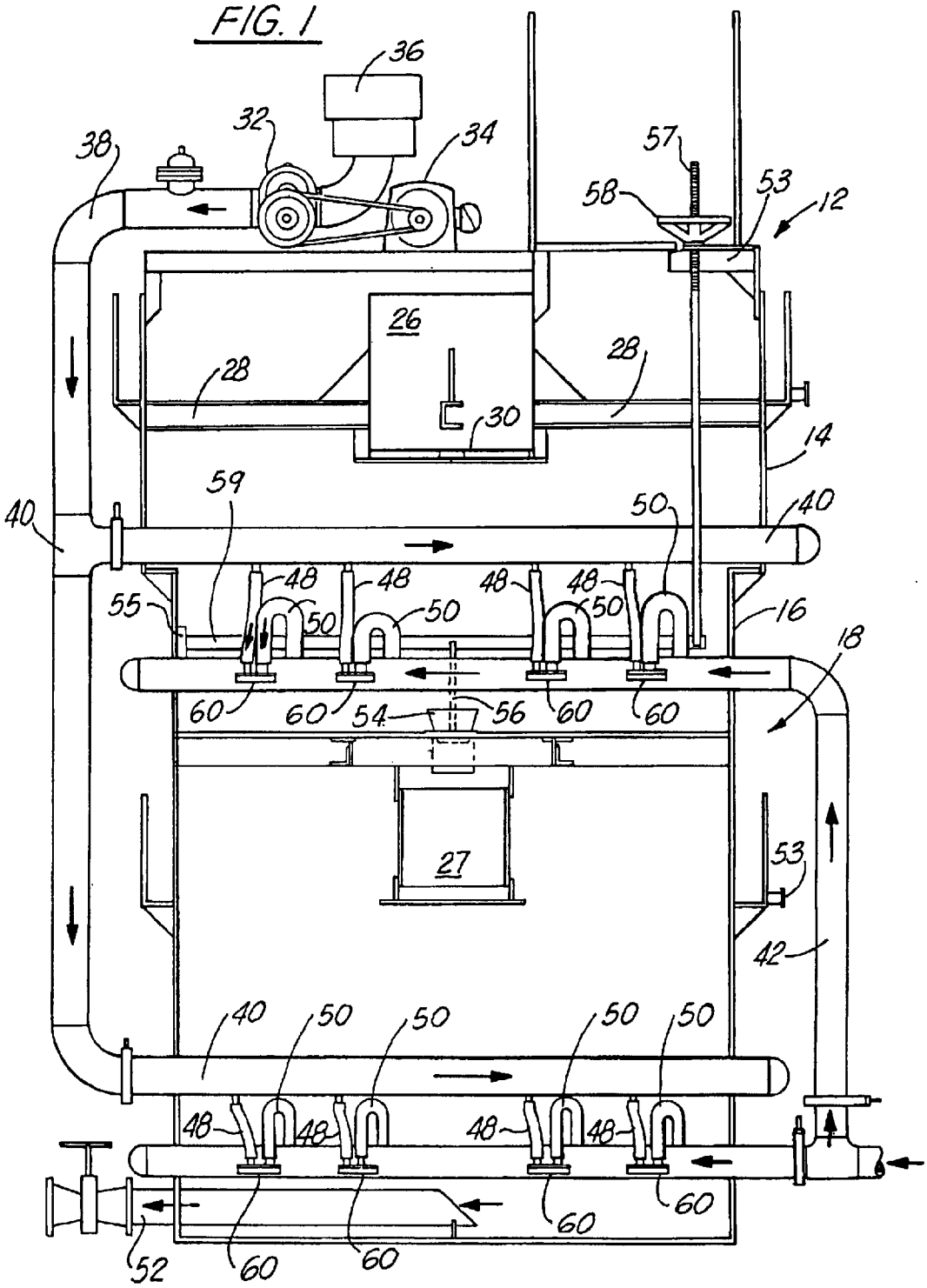
FIG. 1 illustrates a front elevational cross-section of the improved flotation separation apparatus of the present invention.
Figure 2:
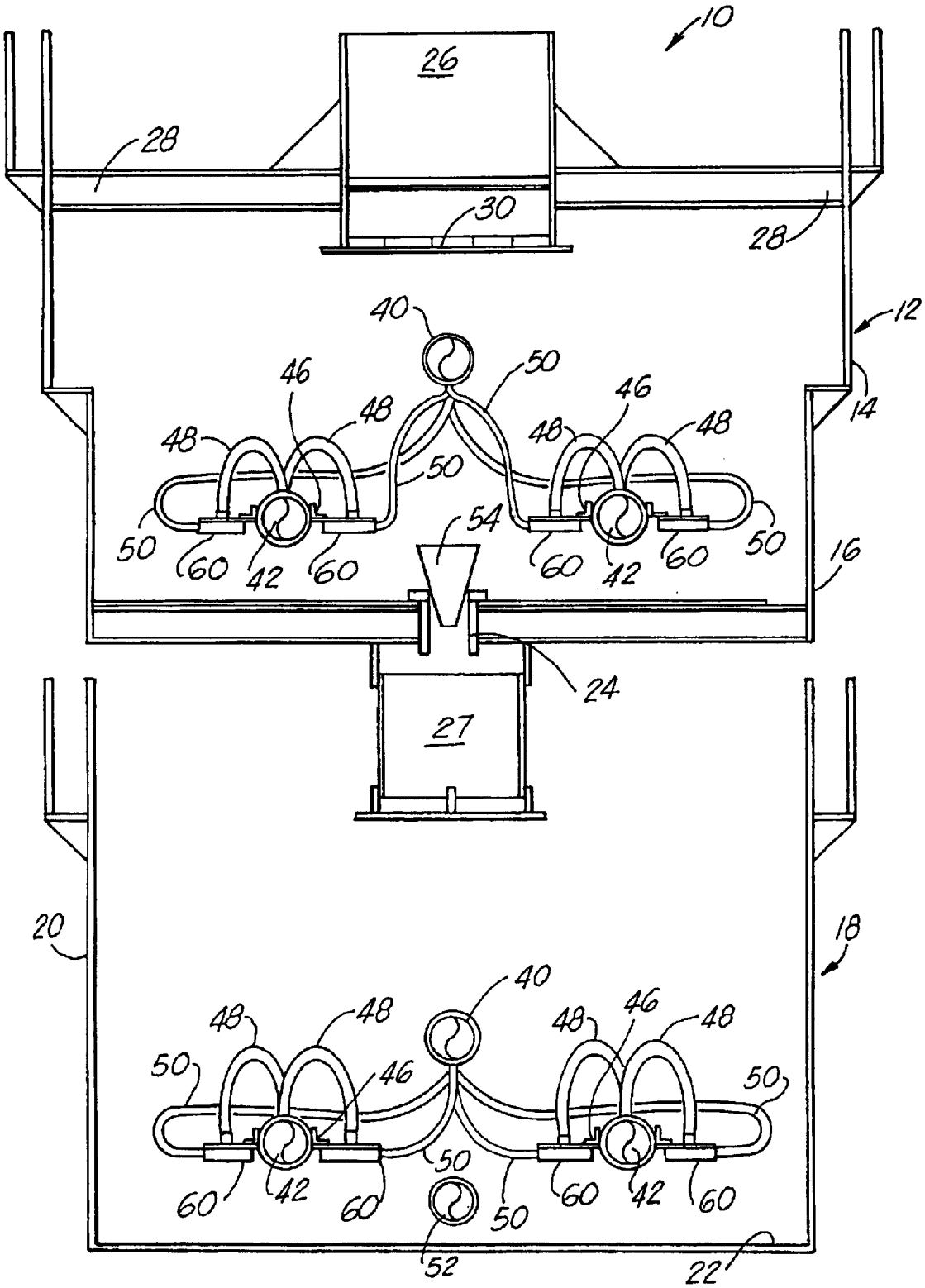
FIG. 2 illustrates a side elevational cross-section of the improved flotation separation apparatus of the present invention.

Referring now to the drawing, and in particular FIGS. 1 and 2, the improved floatation separation apparatus of the present invention is designated generally by the numeral 10. The improved floatation separation apparatus 10 is generally comprised of a first chamber 12, a second chamber 18, an air distribution system 11, a water distribution system 13 and a plurality of unique high volume air bubble infusers 60.

The first chamber 12 is defined by a side wall 14 and a bulkhead 16. The side wall 14 is generally cylindrical in shape. Nevertheless, other shapes may be employed. The second chamber 18 is defined by a side wall 20 and a floor 22, the side wall 20 likewise being generally cylindrical in shape and axial with the cylindrical side wall 14 of the first chamber 12. First and second chambers 12 and 18 are disposed in a stacked relationship, communication between the first chamber 12 and the second chamber 18 being effected by a throat 24 extending though the bulkhead 16.

Referring to the top of the first chamber 12 as shown in FIG. 1, the improved flotation separation apparatus 10 further includes an intake feed well 26 supported by struts 28 extending to the side wall 14. The intake feed well 26 includes a bottom plate 30 having holes (not shown) through which a slurry to be treated can enter the first chamber 12. The lower second chamber 18 further includes a feed well 27 under the throat 24 having a similar purpose for allowing feed of the slurry from the first chamber 12 into the lower second chamber 18.

Referring still to the top of FIG. 1, the air distribution system 11 includes an air compressor 32 driven by a motor 34 and having an associated air filter 36 is provided. The air compressor 32 pumps air through a supply pipe 38 to additional air pipes 40 extending through the respective side walls 14 and 20 and across the respective chambers 12 and 18. The ends of the air pipes 40 are capped, so as to pressure feed air to each unique high volume air bubble infuser 60 via a respective air tube 48, as is described in greater detail below.

The water distribution system 13 includes water feed pipes 42 which are likewise disposed through the respective side walls 14 and 20 and across the respective chambers 12 and 18. Water is fed through the water feed pipes 42, which are capped at the end so as to effect a pressure feed of water via a respective water tube 50 into a respective one of the unique high volume air bubble infusers 60.

Referring now to FIG. 2, the plurality of unique high volume air bubble infusers 60 includes a first set of unique high volume air bubble infusers in the first chamber 12 and a second set of unique high volume air bubble infusers in the second chamber 18. Pairs of infusers of the first set of unique high volume air bubble infusers are rigidly coupled to opposite sides a respective water feed pipe 42 via support brackets 46. Likewise, pairs of infusers of the first set of unique high volume air bubble infusers are rigidly coupled to opposite sides a respective water feed pipe 42 via support brackets 46. As shown, each of the chambers 12 and 18 each include two water feed pipes 42 in side-by-side spaced relation.

As shown in FIG. 1 there are four pairs of unique high volume air bubble infusers spaced along each respective of the two water feed pipes 42 in each chamber. Thus there are sixteen (16) infusers in first chamber 12 and chamber 18.

The unique high volume air bubble infuser 60 is described in greater detail below with reference to FIGS. 3–5. As described above, each unique high volume air bubble infuser 60 is coupled via the respective air and water tubes 48 and 50 to the air and water pipes 40 and 42.

As shown at the bottom of FIG. 1, the improved flotation separation apparatus 10 further includes tailings outlet 52 extending through the side wall 20 of the lower second chamber 18, and a concentrate outlet 53 near the top of the lower second chamber 18.

Again noting FIG. 1, a "dart" or plug 54 is positioned in the port 24 and is movable to control the amount of slurry flow from the upper first chamber 12 to the lower second chamber 18. The plug 54 is provided with a shaft 56 which is attached to a rocker arm 59 coupled at one end to a pivot 55 mounted on the side wall 14 of the upper first chamber 12. The other end of the rocker arm 59 is coupled to a vertical arm 57 which is threaded at the top thereof. The threaded end of the vertical arm 57 extends through a bracket 53 and is threaded through a rotatable hub 58. Rotation of the hub 58 moves the vertical arm 57 up and down, likewise causing corresponding movement of the rocker arm 59, thereby moving the plug 54 into and out of the throat 24 in the desired manner.

Figure 3:
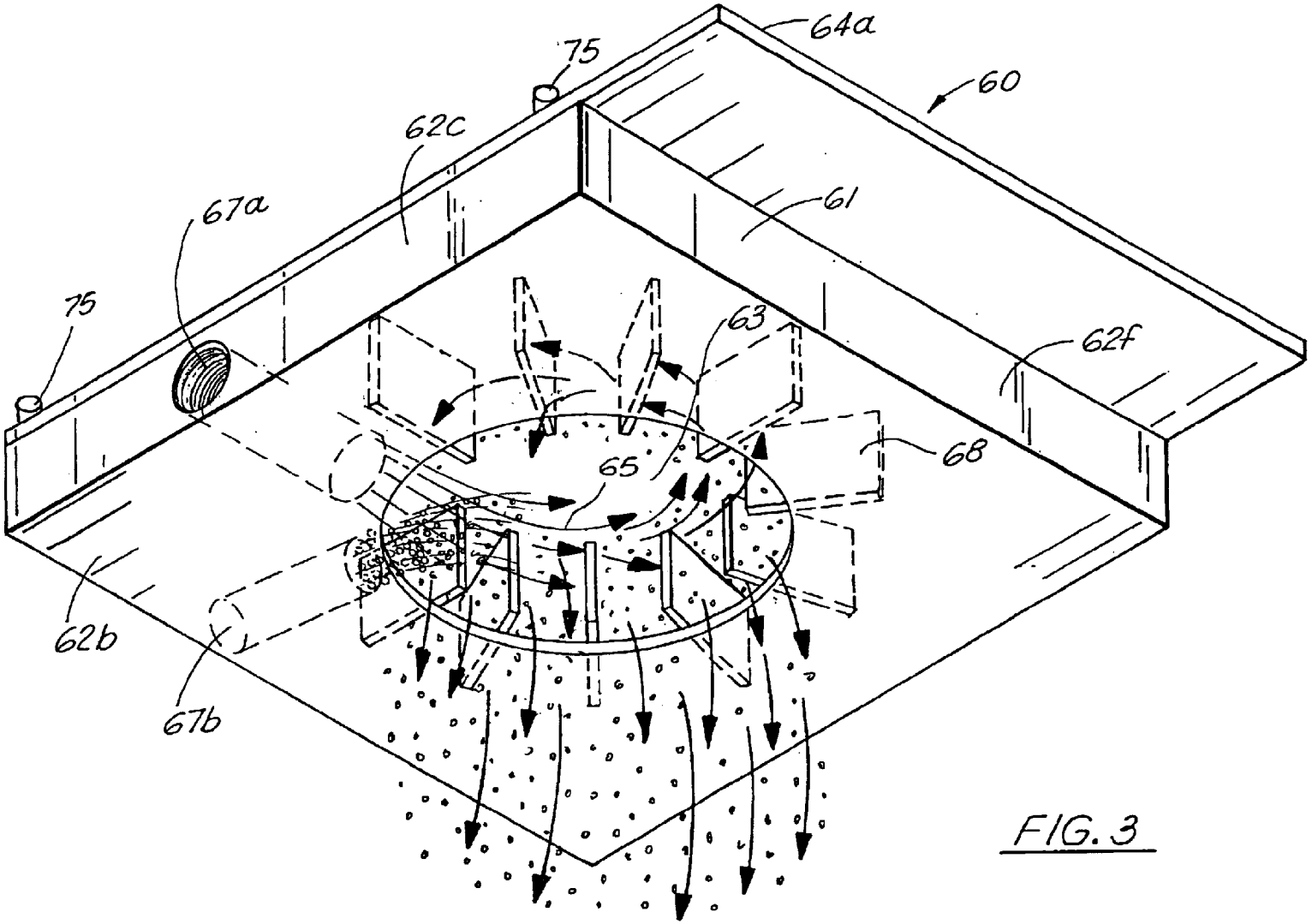
FIG. 3 illustrates a perspective bottom view of the unique high volume air bubble infuser of the present invention.
Figure 4:
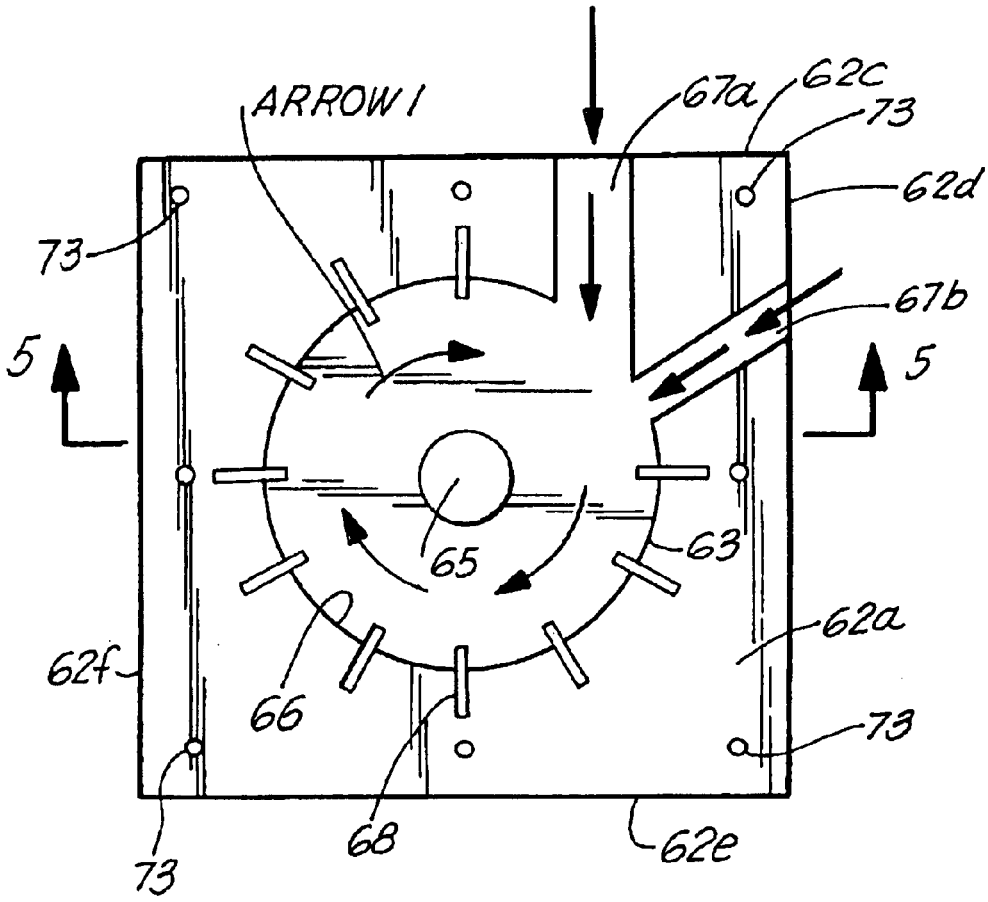
FIG. 4 illustrates a top view of the structure of the infuser.
Figure 5:
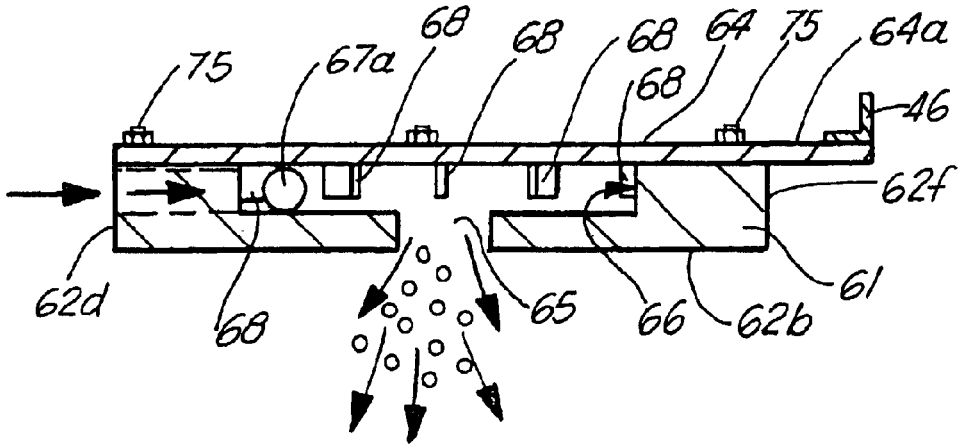
FIG. 5 illustrates a cross-sectional view along the PLANE 4—4 of FIG. 4 of the unique high volume air bubble infuser.

Referring now to FIGS. 3–5, the unique high volume air bubble infuser 60 of the present invention includes a solid structure 61, generally square shaped, having formed in the top surface 62*a* thereof circular infuser cavity 63 and a lid member 64. The top surface 62*a* has formed therein a plurality of holes 73 near the outer perimeter of the structure 61. The lid member 64 is secured to top surface 62*a* via a plurality of bolts 75 threadably received in holes 73.

Referring specifically to FIG. 5, the lid member 64 is fitted to the square area of the structure 61 and further includes extension 64*a* which projects beyond side wall 62*f* of structure 61. Thereby, the lid member 64 is generally rectangularly shaped. The top surface of extension 64*a* has rigidly coupled thereto supporting bracket 46 for coupling the unique high volume air bubble infuser 60 to a side of one of the water feed pipes 42.

The unique high volume air bubble infuser 60 further includes bubble-water discharge outlet 65 formed in the bottom surface 62*b* of structure 61, a water inlet port 67*a* and an air inlet port 67*b*. Both the water inlet port 67*a* and the air inlet port 67*b* are generally cylindrical channels form in side surfaces 62*c* and 62*d*, respectively, of structure 61.

Bubble-water discharge outlet 65 formed in the bottom surface 62*b* of structure 61 allows the created high volume of finely divide strong air bubbles and water to be expelled therethrough.

The axis of the channel of defining the water inlet port 67*a* is essentially perpendicularly to side wall 62*c* and is offset from the axis of circular cavity 63 so as to inject a water stream near the interior circumferential wall 66 defining the circular profile of cavity 63. The axis of the channel of the air inlet port 67*b* intersects the water stream at an acute angle in close proximity to the entry of the water stream into the circular cavity 63. The acute angle of the injected air stream allows such air stream to be carried with the water stream around the interior circumferential wall 66 to create an injection stream. The water steam flows at a rate significantly faster than the air stream. The air stream is injected into said water stream at an angle less than 90 degrees.

Projecting from the interior circumferential wall 66 into circular cavity 63 are a plurality of stationary impinging plates 68 equally spaced incrementally around such interior circumferential wall 66. Said injection stream forcefully impacts repeatedly in series the stationary impinging plates 68 as the injection stream flows around the interior circumferential wall 66. The rate of injection of the water stream serves to maintain the water stream and thus the injection stream flowing around the interior circumferential wall 66 in the direction of ARROW 1.

As the injection stream forcefully impacts the stationary impinging plates 68, the injection stream is divided into strong air bubbles. Therefore, as the injection stream impinges (impacts) upon each individual station impinging plate 68 air bubbles are created and divided. Hence, as the injection stream impinges on the series of impinging plates 68, the created air bubbles have been repeated divided and subdivided as the injection stream completes its rotation through the plurality of stationary impinging plates 68.

In the exemplary embodiment, there are ten impinging plates equally spaced incrementally over substantially 270 degrees of said circular cavity. The discharge outlet 65 has a diameter of 1½ inches. The air inlet port 67*b* has a diameter of approximately ⅜ of an inch and said water inlet port 67*a* has a diameter of approximately ¾ of an inch. The structure 61 is 8 inches×8 inches×1½ inches and said circular cavity 63 is approximately 1 inch deep.

The method of operation of the improved floatation separation apparatus 10 includes the removing from the ground in bulk phosphate, coal, or other substances and mixing the phosphate, coal or other substances in a slurry with well-known emulsifiers and surfactants. The slurry is then fed through the intake feed well 26 into the first chamber 12. Air is fed through the feed pipes 28 and into pipes 40 to infusers 60 through tubing 48. Water is likewise fed through the pipes 42 into the infusers 44 via the tubes 50.

Air enters in feed pipes 38 flows at approximately 4–5 psi and water enters pipes 42 at a minimum of 30 psi.

The air bubbles (transportation means) passing out the plurality of unique high volume air bubble infusers 60 bubbles upward through the first chamber 12 and carries the desired minerals upward into the top of the first chamber 12, in accordance with the standard procedure in a flotation separation process. Likewise, the heavier material sink to the bottom of the first chamber 12 and against the bulkhead 16. However, as noted above, tailings frequently include heavier masses of desired mineral being extracted. In accordance with the present invention, the plug 54 is controlled so as to allow the tailings from the first chamber 12 to pass with the slurry into the lower second chamber 18 through the feed well 27. After the lower second chamber 18 has been filled with the slurry, bubbling of air from the plurality of infusers 60 in the lower second chamber 18 is continue. Thereby, additional amounts of the desired mineral are likewise removed from the slurry and are passed out of the concentrated output port 53. The remaining tailings sink to the bottom of the lower second chamber 18 and are passed out of the tailing outlet 52.

It will be understood by those skilled in the art that, prior to operation of the plug 54, a standard scraping or similar removal process takes place at the top of the first chamber 12 to remove the quantities of floated mineral which have been bubbled to the top of the first chamber 12 may be fed together with the output of the concentrated outlet 53 for storage or further refining.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed is:

1. A flotation separation apparatus for separating and classifying diverse, liquid-suspended solids, said flotation separation apparatus comprising a first chamber and a second chamber stacked below said first chamber in fluid communication with said first chamber, the improvement comprising:

(a) a first set of a plurality of high volume air bubble infusers spaced in said first chamber; and, (b) a second set of a plurality of unique high volume air bubble infusers spaced in said second chamber wherein each unique high volume air bubble infuser comprises:

(i) a structure having formed centrally in a top surface thereof a circular cavity defining an interior circumferential wall and centrally in a bottom surface parallel to said top surface a bubble-water discharge outlet coaxial with an axis of said circular cavity;

(ii) a lid member secured to said top surface of said structure;

(iii) a water inlet port formed in said circular cavity for injecting a water stream into said circular cavity offset from said axis and perpendicular to said axis;

(iv) an air inlet port formed in said circular cavity for injecting an air stream into said water stream at an acute angle; and, (v) a plurality of stationary impinging plates projecting from said interior circumferential wall into said circular cavity and spaced circumferentially in series therealong.

2. The apparatus of claim 1, wherein said water stream and said air stream create an injection stream which impinges in series upon said stationary impinging plates to create, divide and subdivide repeatedly in series air bubbles.

3. The apparatus of claim 2, wherein said circular cavity is a relatively narrow circular cavity having injected therein at a relatively high rate said injection stream to create a sufficient impact force through the series of stationary impinging plates to maximize the rate of the creation of said air bubbles and the discharge thereof through said bubble-water discharge outlet.

4. The apparatus of claim 3, wherein said water stream flows at a rate significantly faster than said air stream.

5. The apparatus of claim 3, wherein said air stream is injected into said water stream at an angle significantly less than 90 degrees.

6. The apparatus of claim 1, wherein there are ten (10) impinging plates incrementally equally spaced over substantially 270 degrees of said circular cavity.

7. The apparatus of claim 1, wherein said discharge outlet has a diameter of 1½ inches.

8. The apparatus of claim 7, wherein said air inlet port has a diameter of approximately ⅜ of an inch and said water inlet port has a diameter of approximately ¾ of an inch.

9. The apparatus of claim 1, wherein said structure is 8 inches×8 inches×1½ inches and said circular cavity is approximately 1 inch deep.

* * * * *